United States Patent [19]

Lapoule et al.

[11] Patent Number: 4,793,547

[45] Date of Patent: Dec. 27, 1988

[54] DIVIDING RACK FOR PACKING BOX

[75] Inventors: Patrick Lapoule, Merignac; Jean-Claude Roger, Ruelle, both of France

[73] Assignee: Societe Cooperative Ouvriere De Production Anonyme A Capital Et Personnel Variables, France

[21] Appl. No.: 823,412

[22] Filed: Jan. 28, 1986

[30] Foreign Application Priority Data

Jan. 28, 1985 [EP] European Pat. Off. ..... 85450003.0
Jun. 19, 1985 [FR] France ..... 85 09427

[51] Int. Cl.[4] ..... B65D 5/48

[52] U.S. Cl. ..... 229/120.27; 229/120.26; 229/120.29

[58] Field of Search ..... 229/15, 27, 28 R, 42, 229/120.26, 120.27, 120.29; 217/22, 32, 33

[56] References Cited

U.S. PATENT DOCUMENTS

| | | | |
|---|---|---|---|
| 2,785,844 | 3/1957 | Metzger | 229/28 R |
| 3,208,659 | 9/1965 | Blasdell et al. | 229/27 |
| 4,030,660 | 6/1977 | Rada et al. | 229/15 |

FOREIGN PATENT DOCUMENTS

| | | | |
|---|---|---|---|
| 21404792 | 2/1973 | Fed. Rep. of Germany | 229/42 |
| 3432854 | 11/1985 | Fed. Rep. of Germany | 229/15 |
| 78669 | 7/1962 | France | 229/28 R |
| 2479145 | 10/1980 | France | 229/15 |
| 1205004 | 11/1965 | German Democratic Rep. | 229/15 |
| 322518 | 6/1957 | Switzerland | 229/28 R |

*Primary Examiner*—Stephen Marcus
*Assistant Examiner*—Gary E. Elkins
*Attorney, Agent, or Firm*—Robert J. Koch

[57] ABSTRACT

Dividing racks for parallelepipedal packing box, made from one cut-out cardboard flank, grooved and formed in order to build a plurality of adjacent individual divisions which are rectangular panels, rigid and divided by orthogonal and parallel cutting and grooving lines. The formed rack includes a double vertical central partition, two double lateral partitions extending from both sides of the central partition, single panel partitions orthogonal to the central partitions, single panels extending from the single panel partitions, and three single panels in one plane, in the continuation of the connection panels of the double partitions and the single partitions and parallel with the double partitions. When formed, the rack exhibits central segments dividing two panels of the double partition from the lateral partitions and form an outwardly protruding portion straddling the two panels, and locking slots at right angles with dividing lines between single panels and extension panels. Additionally, a machine for automatically forming racks having a station where stacked cut-out flanks are individually gripped, a station for forming and inserting racks adjacent to the gripping station, apparatus to convey each flank from the gripping station to above a forming station forming unit, a device to force the flanks through the forming unit and to push the formed rack into a box, and a system for supplying the empty boxes and removing boxes provided with rack.

8 Claims, 16 Drawing Sheets

DIVIDING RACK FOR PACKING BOX

BACKGROUND OF THE INVENTION

1. Field of the Invention

This invention relates to a new structure of dividing rack for packing box and to a suitable machine for the automatic forming of said rack and its insertion into the packing box.

2. Description of the Related Art

When packaging several objects arranged side by side in parallelepipedal boxes, said boxes must be provided inside with a kind of grid designated as rack that forms within the box receiving recesses for the objects that are thereby kept mutually apart, wedged and protected. Said racks are generally made of double-sided corrugated cardboard and the existing methods of manufacture have a number of disadvantages.

For some configurations of racks, their cutting out from a cardboard flank does not allow a rational and optimum use of the material and it gives rise to a high percentage of trimmings and waste which adversely affects cost. In other instances the rack is made of several sections that need assembling by joining and/or pasting.

When these operations are made automatic, they involve extra cost and the inventory of materials and parts is difficult to control.

Either manual or mechanized assembling lacks functionalism and requires excessive time (if manual) or excessive space and investments (if mechanized).

A special type of rack has been disclosed however; it is cut out from a cardboard flank so that a mere folding operation forms a dividing grid suitable among other application, for packaging twelve bottles together.

The principle of this rack is illustrated by example on documents FR-A Nos. 70.09816, 80.07129 and 84.01794.

This rack basically consists of rectangular or square-shaped panels in one-piece configuration; they are divided by orthogonal or parallel cutting and/or grooving lines which, when the rack is given its shape, determine a double vertical central partition produced by the folding of two middle panels against one another, two double lateral partitions both in the plane and on either side of said middle partition which are produced too by the folding of two adjacent panels against one another and finally partitions that are orthogonal to the above-mentioned partitions and are made by single panels.

In the version of such a rack intended for the packaging of twelve objects, said single partitions are complemented by more single panels and said connection panels are complemented by three single panels in the same plane and raised at 90° in order to be in parallel arrangement with said double middle partitions.

However these racks have the severe drawback not to be suitable for mechanical and fully automatic forming and installing since they lack the necessary means to assure a firm mutual holding of the various partitions in orthogonal arrangement when they are being formed and positioned, which is an essential requirement for any automatic packaging line.

SUMMARY OF THE INVENTION

The object of the invention is namely to obviate said disadvantages by proposing improvements for the above-described racks so that they become suitable for a fully automatic forming and insertion into packing boxes through a machine specially designed for the purpose.

To this purpose, the object of the invention is a dividing rack for parallelepipedal packing box, made from one cardboard flank that is cut out, grooved and formed in order to build a plurality of adjacent individual divisions which comprise rectangular or square panels, sold with each other and divided by orthogonal or parallel cutting and/or grooving lines, which, when the rack is formed, form the following individual elements:

A double vertical central partition,

Two double lateral partitions in the plane and on either sides of said central partition, Single panel partitions orthogonal to the above-mentioned partitions, Single panels extending in the continuation of the above-mentioned partitions, and Three single panels in one plane, in the continuation of the connection panels of said double partitions and said single partitions and parallel with said double partitions, said rack being characterized by the fact that it further comprises:

Central cuttings up that divide the two panels of the double central partition and the panels of the two double lateral partitions and form on their inner-edge an outwardly protruding portion that straddles the two above-mentioned panels, and slots made in said three single panels and capable of locking when the rack is given its form, at right angles with the dividing line between the single panels on the one hand and their extension panels on the other hand.

A further object of the invention is a machine for the automatic forming of the above-described rack, comprising:

A station where flat stacked cardboard cut-out pieces are gripped one by one,

A station where racks are formed and inserted into a box; this station is adjacent to the first one and comprises suitable means for the forming of the rack, Means to convey each cut-out cardboard piece from the gripping station to the forming station above the forming unit, Means to force said cut-out cardboard to go through said forming unit and to push the formed rack into the box, and System for supplying empty boxes and for removing boxes provided with their rack.

The other features and advantages of the racks according to the invention will appear more clearly from the following description of modes of embodiment of said racks and machine, this description being given as an example only and with reference to the appended drawings.

DETAILED DESCRIPTION OF THE PREFERRED EMBODIMENT

Figure 1:
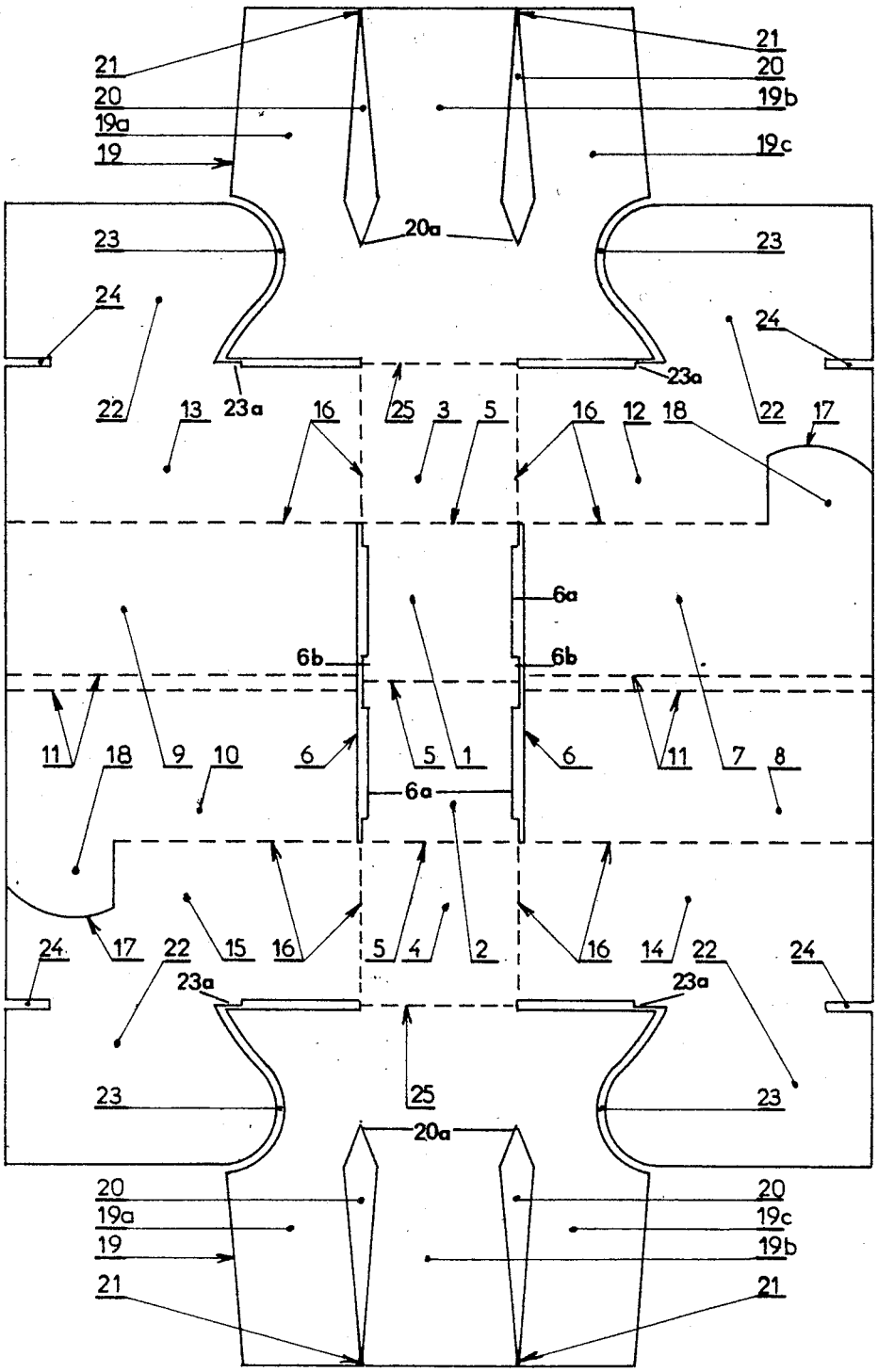
FIG. 1 illustrates a first method of implementation of a flat cut-out cardboard for a rack according to the invention, for packaging twelve objects.

According to a first method of implementation, a rack cut-out of the invention is illustrated, it is designed for the packaging of groups of twelve objects and is made, by way of example, from a double-side corrugated cardboard flank.

The cut-out shown comprises two square central panels 1 and 2, flanked by two external square panels 3 and 4, said panels 1 to 4 being individualized by grooving lines 5.

The remaining sides of panels 1 and 2 are free owing to cut-ups 6 which separate said panels 1 and 2 from two pairs of adjacent rectangular panels 7,8 and 9,10.

Cut-ups 6 have a special configuration and consist of a notch whose internal edge **6*a* (at right angles with panels 1 and 2) is set off toward the center of said panels with respect to the folding lines 16 which separate panels 12 to 15 from panels 3 and 4. In addition said edge 6*a* is provided in its central portion in straddling position over both panels 1 and 2 with a portion 6*b* protruding towards the double lines 11. The purpose of the cut-ups 6** will be clarified further on.

The adjacent panels 7,8, on the one hand, and 9,10, on the other hand, are separated by a double groove line 11 designed to facilitate the folding back of the panel 7 over the panel 8 and of the panel 9 over panel 10 as described later.

External square panels 3 and 4 are each a one-piece construction with two rectangular panels 12,13 and 14,15, that are in the same one-piece arrangement with the adjacent panels 7, 9, 8 and 10. Grooving lines 16 individualize the panels.

The grooving line 16 dividing panels 7,12 and 10,15 does not extend up to the outer edge of the cut-out, but, according to a well-known configuration, it stops and is continued by a notch 17 that forms a flap 18 integral with the panel 7 or 11 and encroaches on the surface of the adjacent panel 12 or 15.

On the other hand, each panel 3,4 is continued on the side opposite to panels 1,2, by a panel 19 divided in three portions **19*a*, 19*b*, 19*c* that are separated by slots 20 connected with the outer edge of the panel 19 by a cutting line 21. The axis of the slots 20 is in prolongation of cut-ups 6**.

Finally, the panels 12 and 13 are continued by two panels 22 that partially encroach on the surface of opposed portions **19*a* and 19*c* with a round cut-up 23. Besides a slot 24 is provided on the limit between panels 14,22 and 15,22 and at right angles with the outer edge of the rack cut-out, while the cut-up that separate panels 12 to 15 and panels 19*a* and 19*c* is widened in order to form a projection 23*a*, capable of co-operation with the bottom 20*a* (inner edge) of the associated slot 20**, as described hereafter.

Panels 14 and 15 are extended in the same way.

In the above-described structure illustrated in FIG. 1, the principle of the cut-up represented by the various panels 1 to 4, 7 to 10, 12 to 15, 22 and **19*a* to 19*c* is well-known as such and the new characteristics of said structure relate to the means (6, 6*a*, 6*b*; 20, 20*a*; 21, 23*a*, 24**) utilized to assure a mutual locking of the individual partitions once the rack has been formed, so that the partitions retain their orthogonal position in relation to one another when the rack is being introduced into the packing box and later on, in an automatic packing line, for the insertion of bottles for instance.

The expansion or forming of the rack is achieved by plain folding along the various grooved lines shown in broken lines on FIG. 1.

Figure 2:
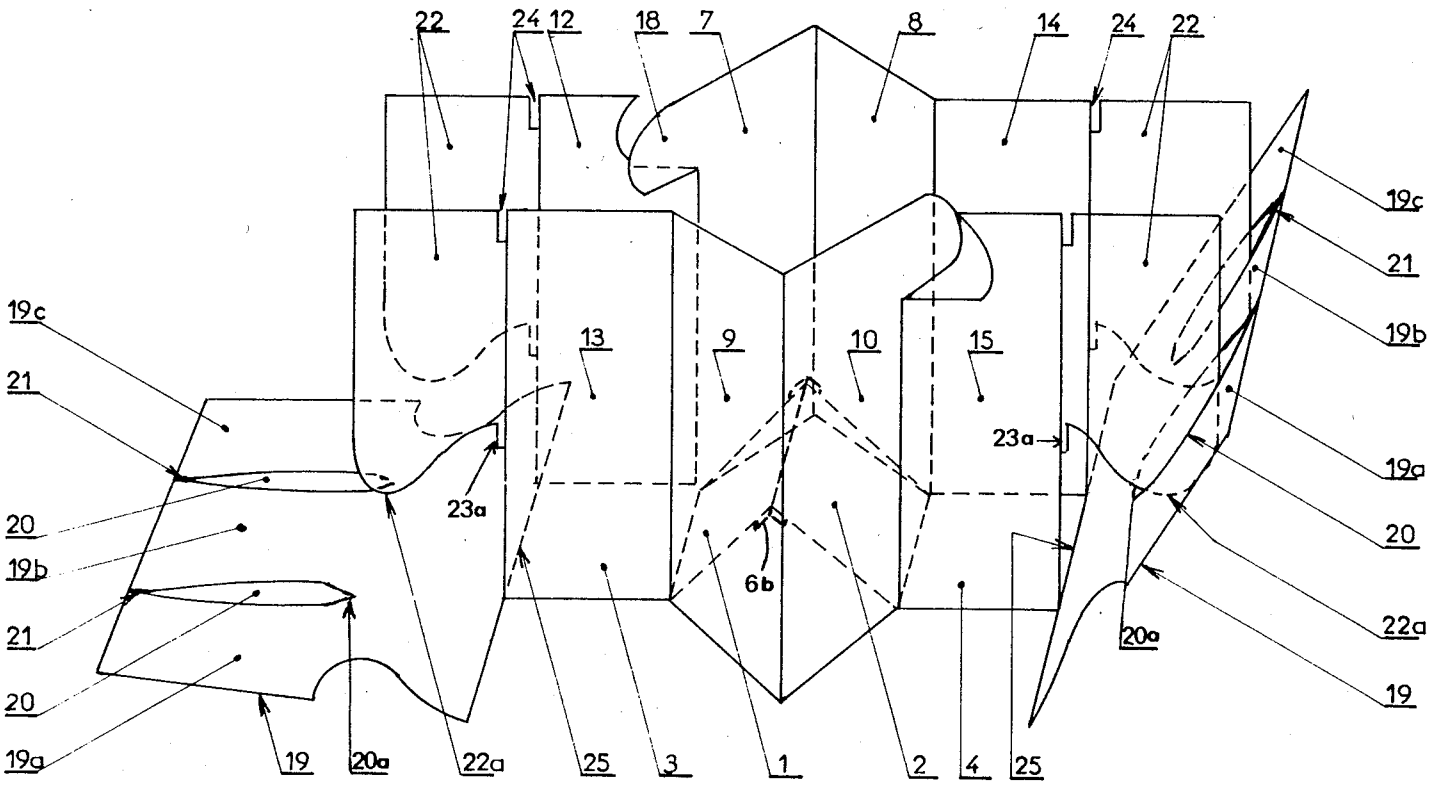
FIG. 2 is a perspective view of a nearly formed rack from the cut-out shown in FIG. 1.

The forming is illustrated in FIG. 2. The forming principle is to raise both central square panels 1 and 2 towards the center of the rack until they lie flat against each other in order to produce a double central partition that extends from the base of the rack up to a definite height. At the same time, the panels 7,8 and 9,10 are also brought together and folded against each other towards the outside of the rack in order to form two double partitions (7,8 and 9,10) placed in one plane and on either side of said double central partition 1,2 (FIG. 3), with panels 7,8,12,14 and 9,10,13,15 raised at 90° with respect to the external square panels 3 and 4 that remain in the same plane, are drawn nearer to each other until they are adjacent and will come into contact with the bottom of the packing box.

Finally, panels 19 are raised at 90° around the folding line 25 so that they are parallel with the double partitions 7,8 and 9,10.

During the forming process, the slots 20 permit a convenient insertion of the rounded end 22a (FIG. 2) of panels 22 and, at the end of their travel, the adjacent edges of the cut-up 21 come to be engaged into slots 24, while projections **23*a* come to be engaged at the bottom 20*a* of the slots, in order to effectively lock the panels 19** in a vertical position.

Figure 4:
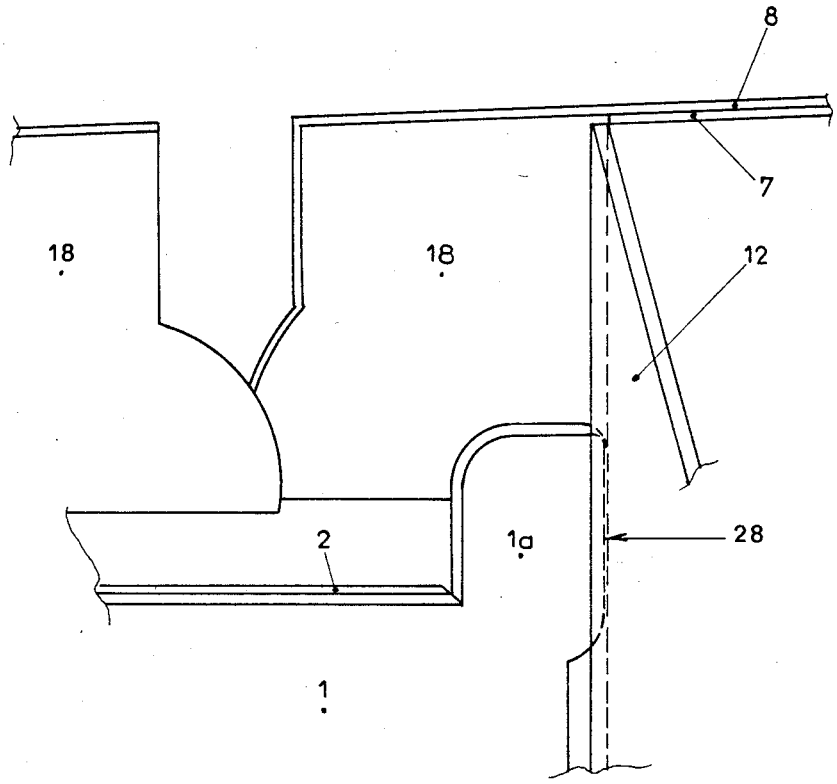
FIG. 4 shows a part perspective view of the central portion of the rack in FIG. 3 when folded.

On the other hand, the double folding lines 11 (not shown in FIG. 2) facilitate the folding of panels 7,8 and 9,10 against each other and their keeping this position, while the configuration of cut-up 6 contributes to an improved steadiness of the rack when formed, and more specially, owing to the protruding portions 6b which (as illustrated hereafter by reference to the method of embodiment of FIG. 4) are sandwiched between the facing edge of panels 12 and 14, on the one hand, and 13 and 15 on the other hand.

In this way, the rack when folded is effectively locked in all directions and the rack partitions and walls are kept in a fully orthogonal position in respect with one another during the insertion into the packing box and during its handling on the automatic bottle packing line.

There is no longer any danger that, at the time of introducing the bottles into the box, any of the partitions is askew and prevents or interferes with the positioning of the bottles or damages the labels.

Figure 3:
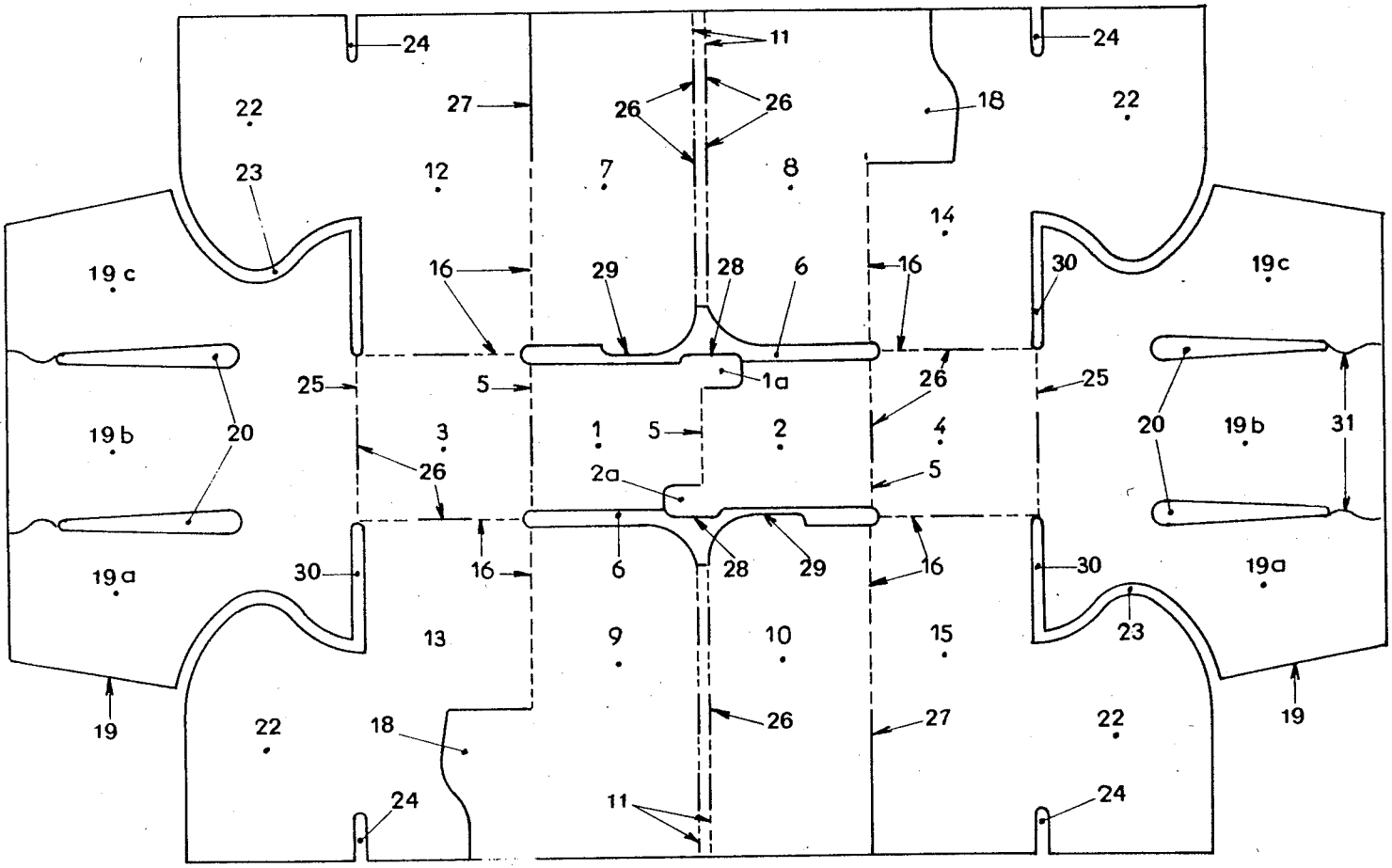
FIG. 3 shows a second method of implementation of a flat cut-out for a rack according to the invention.

FIGS. 3 and 4 illustrate an alternative version of implementation of the cut-out as per FIG. 1, which is the preferred method of embodiment.

In the cut-out of FIG. 3, the elements that are homologous of those of the cut-out in FIG. 1 are identified with the same numerals.

In the preferred method of embodiment, the double folding lines 11 comprise incisions 26 here and there. The folding lines 5, 16 and 25 also include such incisions 26. Moreover, regarding the folding line 16 that separates the panels 7 and 12, on the one hand, and 10 and 15 on the other hand, a special incision 27 is made to correspond to the height of cut-ups 18 provided in panels 14 and 13 in continuation of panels 8 and 9. The advantage of the incisions is that they equalize the folding resistance on either side of the double side walls 7,8 and 9,10 so that, when folded, said walls are kept more firmly still in a perpendicular position with respect to adjacent panels 12,14 and 13,15.

Each panel 1, 2 is continued by mutual encroachment in one corner by means of a rectangular flap 1*a*, 2*a*.

The flaps 1*a*, 2*a* straddle both panels 1 and 2. Moreover, according to an essential characteristic, flaps 1*a*, 2*a* comprise an outer edge 28 that is set off towards the inside of the rack with respect to the corresponding edge of the panel under consideration 1,2. The extent of the set off is such that said edge reaches and very slightly exceeds the axis of the folding lines 16, between panels 3,4 and panels 12, 14, on the one hand, and 13,15 on the other hand. Therefore, when the double rack partitions are folded, (FIG. 4), the flaps 1*a*, 2*a* come to a vertical position in the plane of panels 7,9, with the edge 28 resting against the edge of said panels, while said flaps 1*a*, 2*a* are locked laterally since they are sandwiched between the extensions 18 and the edge of panel 12,14. Further, it can be seen from FIG. 4 that the cut-ups 18 are partly pressed against each other.

Moreover the base of the panels 7,10 comprises a portion 29 that is set off toward the inside of the rack with respect to the inner edge of panels. The extent of the set off is such that said portion 29 reaches and very slightly exceeds the said axis of the folding lines 16 between panels 3,4 and panels 12,14 on the one hand, and 13,15 on the other hand. These special forms are achieved by an appropriate configuration given to the portions left by cut-ups 6. When the rack is folded, the protruding portions 29 that are in the vicinity of the double folding lines 11 are at both ends and at the lower section of the double central cross partition of the rack and therefore form wedges that fully stabilize the rack at the bottom of the packing box.

All the above-mentioned provisions, viz., the incisions 27 for the equalization of folding resistances, the cut-ups 18 with partial overlapping, the flaps 1*a*, 2*a* in sandwich arrangements and extensions 29, provide and ensure a fully satisfactory behaviour of the central double partitions (1,2) and of the central lateral partitions (7,8; 9,10), making it possible to form and fit the rack of the invention by an entirely automatic working machine, without any danger of misalignment of the dividing partitions of the rack.

It is worth mentioning too that, in FIG. 3, the cut-ups 6 have their ends extending slightly beyond the intersection of the folding lines 5, 16, in order to decrease the folding resistances that might interfere with a correct and stable folding of the rack.

With the same objective of reducing folding resistances, the panels 19, as they were in the method of embodiment of FIG. 1, are separated from panels 12 to 15 by a wide slot 30 that is about twice as wide as the cardboard flank thickness.

Finally, slots 20 are continued up to the extreme edge of the panel 19 by a S-shaped incision 31 in the slot axis. This permits an efficient locking of the panel 19 in its raised position, each slot 24 holding the two panels that are adjacent to the incision 31 affected, owing to the S-shaped configuration that slides a portion of each panel in the slot 24.

Figure 5:
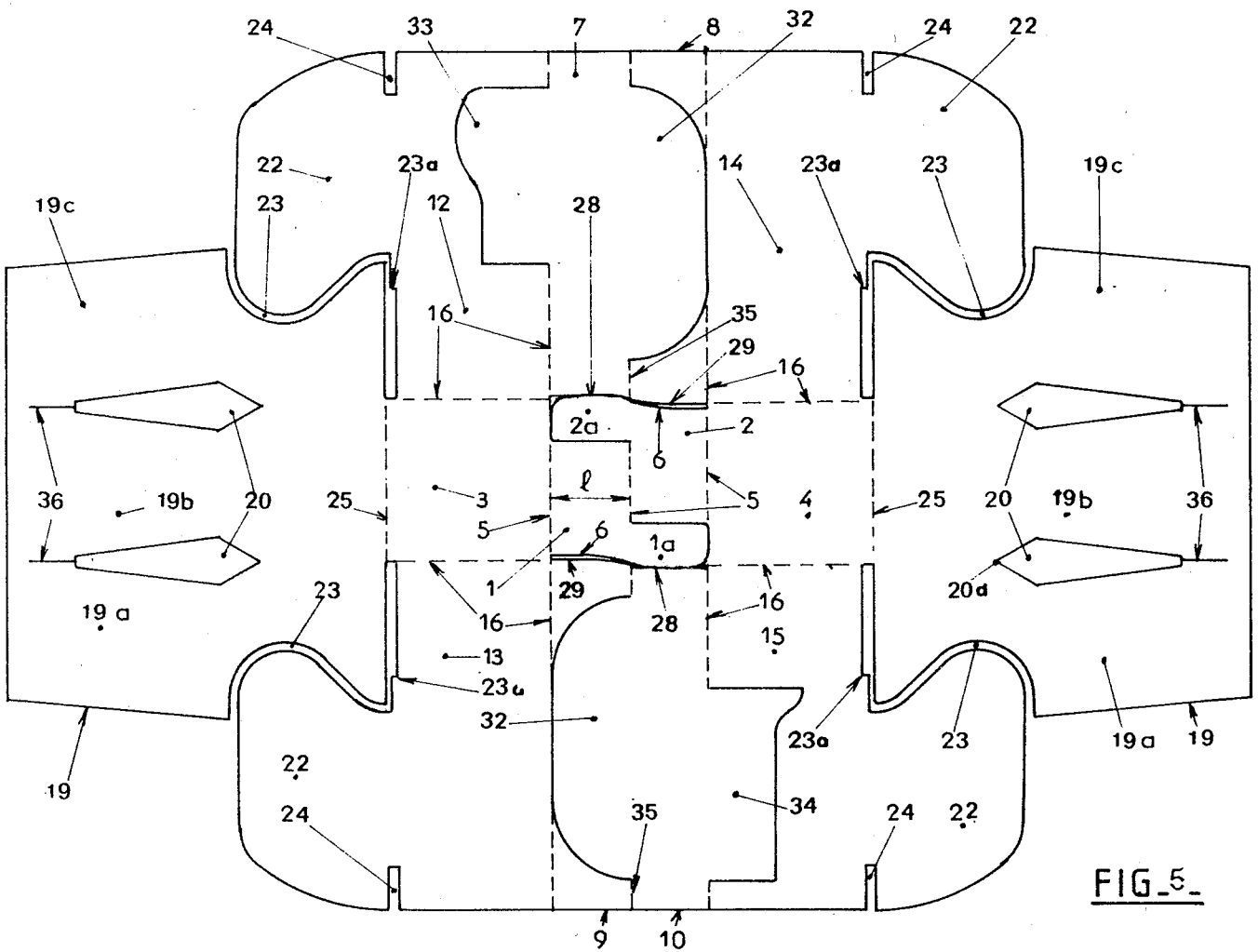
FIG. 5 shows a third method of implementation of the flat cut-out of a rack according to the invention.
Figure 6:
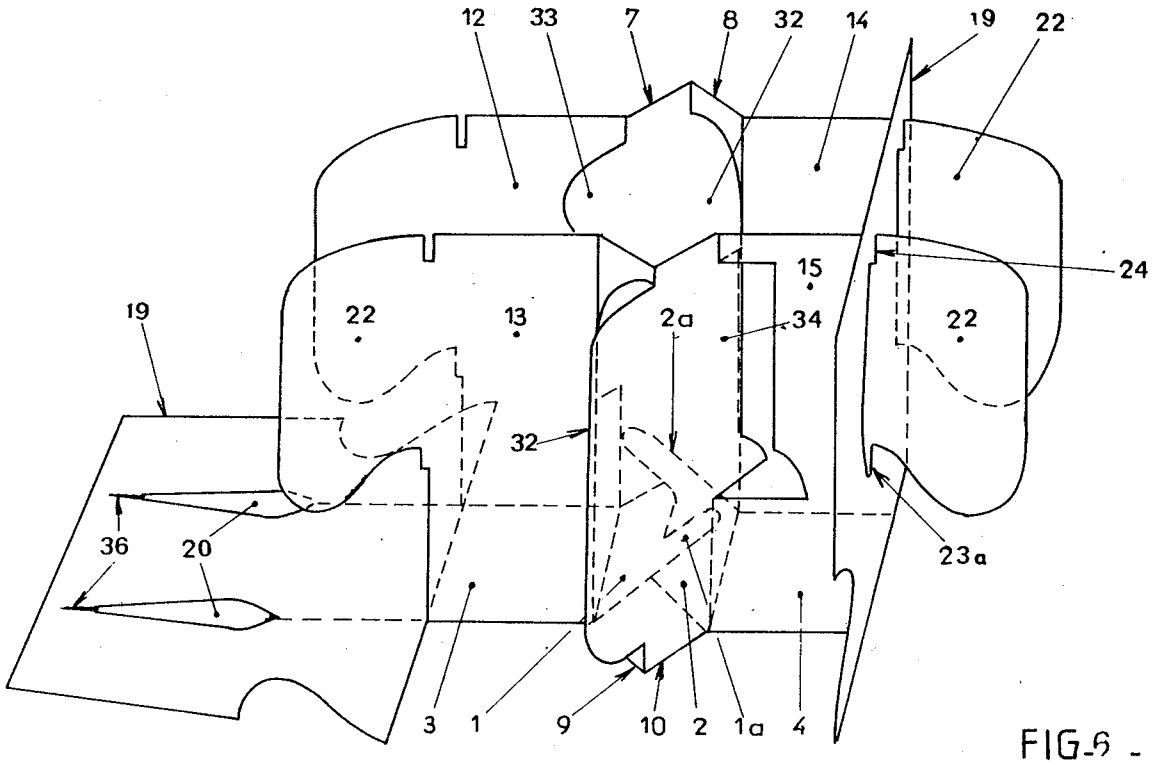
FIG. 6 is a plan view of the rack in FIG. 5 nearly completely formed.

FIGS. 5 and 6 illustrate a further method of embodiment of a cut-out whose homologous elements with those of FIGS. 1 and 3 are identified by identical numerals.

The cut-out is obtained for example from a double-side corrugated cardboard flank and comprises two small rectangular central panels 1 and 2, flanked by two square external panels 3 and 4, with grooving lines 5 to individualize said panels 1 to 4. Note that in the method of embodiment shown, the dimension of the width 1 (perpendicularly to the grooving lines 5) on either side of each panel 1,2 is equal to the half of the squares 3 and 4.

The other sides of the panels 1 and 2 are free, owing to cut-ups 6 that separate said panels 1 and 2 from two pairs of rectangular panels, 7,8 respectively 9,10. The outer square panels 3 and 4 are each integral with two rectangular panels, 12,13 and 14,15, also integral with the relevant adjacent panels 7, 9, 8 and 10. Grooving lines 16 individualize the various panels.

Each rectangular panel 1,2 is continued with mutual encroaching by means of a rectangular cut flap 1a and 2a, whose length is equal to 1.

One panel (7) of the pair 7,8 and one panel (10) of the other pair 9,10 are also extended to the relevant adjacent panels by means of appropriate cut-ups.

In this way, panels 7 and 10 encroach on panels 8 and 9 by an extension 32 whose width is equal to the width of the panels 8,9 and that has a great length covering the central portion of the panels under consideration.

The panels 7, 10 extend on the other side and encroach on panels 12 and 15 by cut-ups 33 and 34, whose configurations are dissimilar so that they can be mutually complementary when the rack is formed as described hereafter.

Panels 7,8 on the one hand, and 9,10 on the other hand, are individualized by a grooving line 35 aligned with the line 5 that separate panels 1,2. Each panel 3,4 is continued on its free edge by a panel 19 divided in three sections 19*a*, 19*b* 19*c* that are separated by rhomb-shaped slots 20 continued by a notch 36 that does not extend up to the end edge of the panel 19. The axis of slots 20 is in prolongation of cut-ups 6.

The panels 14 and 15 are continued by two panels 22 that partly encroach on the surface of opposite portions 19a and 19*c* by a rounded cut-up 23. A slot 24 is provided at the limit between panels 14,22.

The panels 12 and 13 are continued in the same manner.

The panels 19 are folded along a folding line 25.

Finally a projection 23*a* is provided on the edge of panels 12 to 15 and is designed to rest against the bottom of the slots 20 when the rack is assembled.

FIG. 6 illustrates the assembling of the rack of FIG. 5 that is perfectly similar to that of the racks in the preceding figures.

The panels 22 engage the slots 20 and the panels 19 lock vertically, on the one hand owing to the slots 24 engaging notches 36 and, on the other hand owing to the projections 23*a* which go to the bottom of slots 20 on their other end. In this way, the panels 19 are perfectly held vertically.

Note that the upper edge of the panels 19 slightly exceeds the plane defined by the upper edges of the other panels. This permits the union of panels 19*a*, 19*b*, 19*c*, at their end and provides the required rigidity if the rack is folded manually. Should the rack be intended for exclusive application with an automatic rack forming and insertion machine, the above feature is not necessary and in this case, the notches 36 do not go beyond the extreme end edge of the panel 19.

When the panels 1,2; 7,8; 9,10 are completely folded the external vertical edges of extensions 32 are practically at the level of the external vertical edges of panels 19.

In the same manner, the extensions 33 and 34 together form a central partition parallel with the panels 19, in complement of the double partition 1,2. Therefore, and although the panels 7,8 and 9,10 are very limited in width, dividing partitions are achieved through clever cut-ups (32,33,34), said partitions having the same performance as solid ones. These cut-ups can be arranged in the zones where the packaged objects are more subject to damage and they therefore feature varying configurations and dimensions.

As can be seen readily from FIG. 5, the panels 7 to 10 fill a surface of cardboard equal to that of panels 12, 13 or 14, 15, which permits to save from 10 to 15 percent of material in comparison with another cut-out configuration where panels 7 to 10 would have the same width as panels 12 to 15.

On the other hand, the flaps 1*a*, 2*a* move to the position illustrated in FIG. 4 regarding the method of implementation of FIG. 3 and more particularly they come to rest against the lower portion of cut-ups 33 and 34, which ensures a firm hold of panels 7 and 10 in parallel with panels 19. The hold is further increased by the fact that the outer edge of flaps 1*a*, 2*a* is caught between 34 and the edge of the panel 13 on the one hand, and between 33 and the edge of the panel 14, on the other hand.

Figure 7:
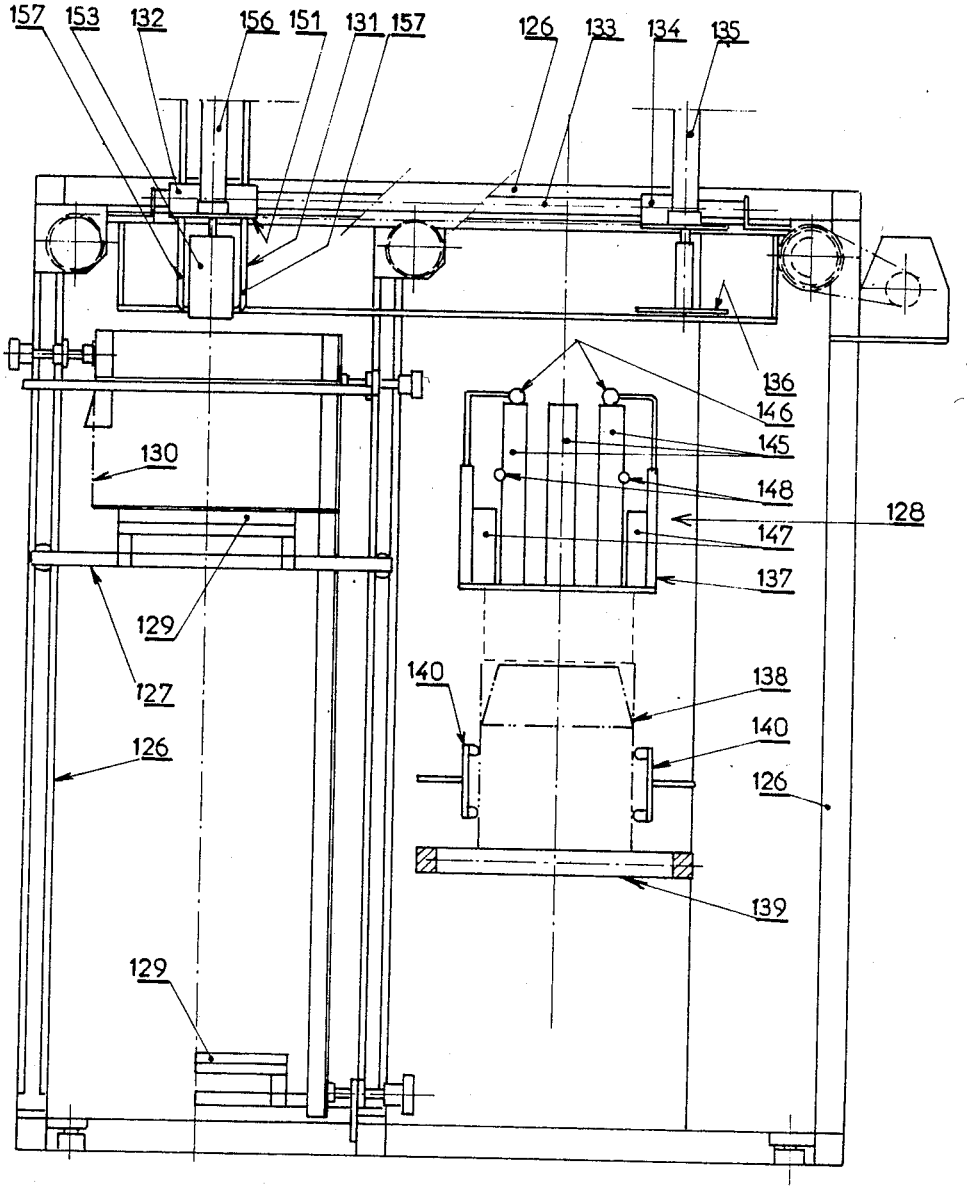
FIG. 7 is a front view of a machine according to the invention designed for the automatic forming of racks according to FIG. 1.
Figure 8:
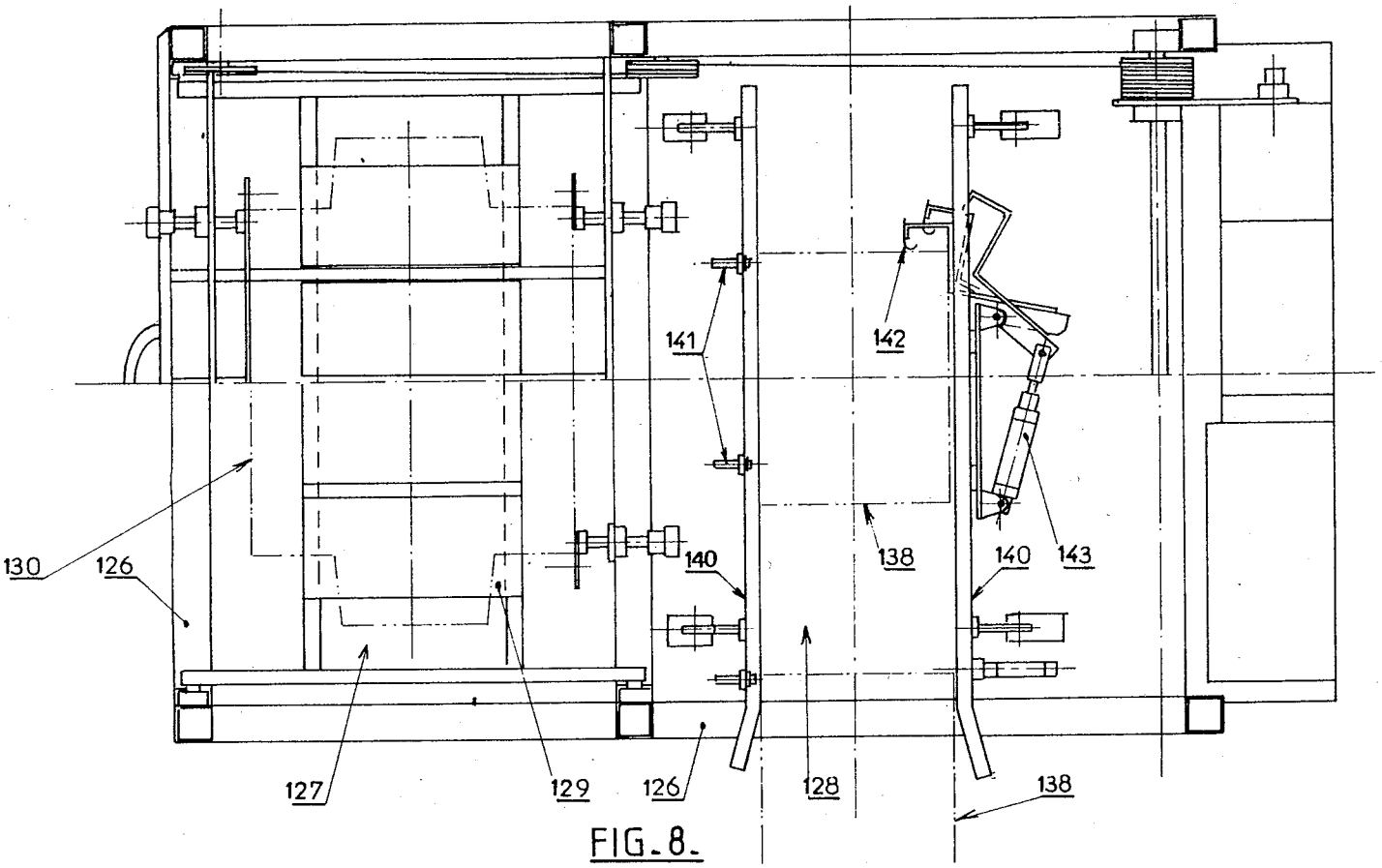
FIG. 8 is a top plan view of the machine in FIG. 7.

Here is now the description of a machine specially designed for the forming of the racks according to the invention, with reference to FIGS. 7 and 8.

The machine consists of a frame 126 carrying a gripping unit 127 for taking the rack cut-outs and an adjacent unit for rack forming and insertion into the packing box 128.

The unit 127 comprises a horizontal lifting plate 129 that carries a stack 130 of flat lying rack cut-outs and a device 131 for taking and moving the cut-outs one by one, said device moving horizontally (FIG. 7) between a position immediately above said stack 130 and another position above the unit 128.

The plate 129 is moved and guided by conventional means that do not require a detailed description. Also, the device 131 is carried by a carriage 132 capable of moving along slides 133 by conventional means. Another carriage 134 can move along said slides, the carriage carries a vertical jack 135 of which the rod is fitted with a pushing plate 136 whose purpose is to complete the forming of the rack in a forming unit 137 and to introduce it into a parallelepipedal open packing box 138 placed below said forming unit 137.

The box 138 travels on a conveyor represented diagrammatically at 139 that crosses the machine the open boxes carried by the conveyor to a position under the forming unit 137 being guided laterally by slides represented diagrammatically at 140.

The correct positioning of the box 138 under the forming unit 137 is sensed by photoelectric cells 141 for instance (FIG. 8) and the box 138 is temporarily immobilized on the conveyor 139 by a retractable stop 142 that is controlled by a jack 143 for the (very short) period required for inserting the rack into the box.

Figure 9:
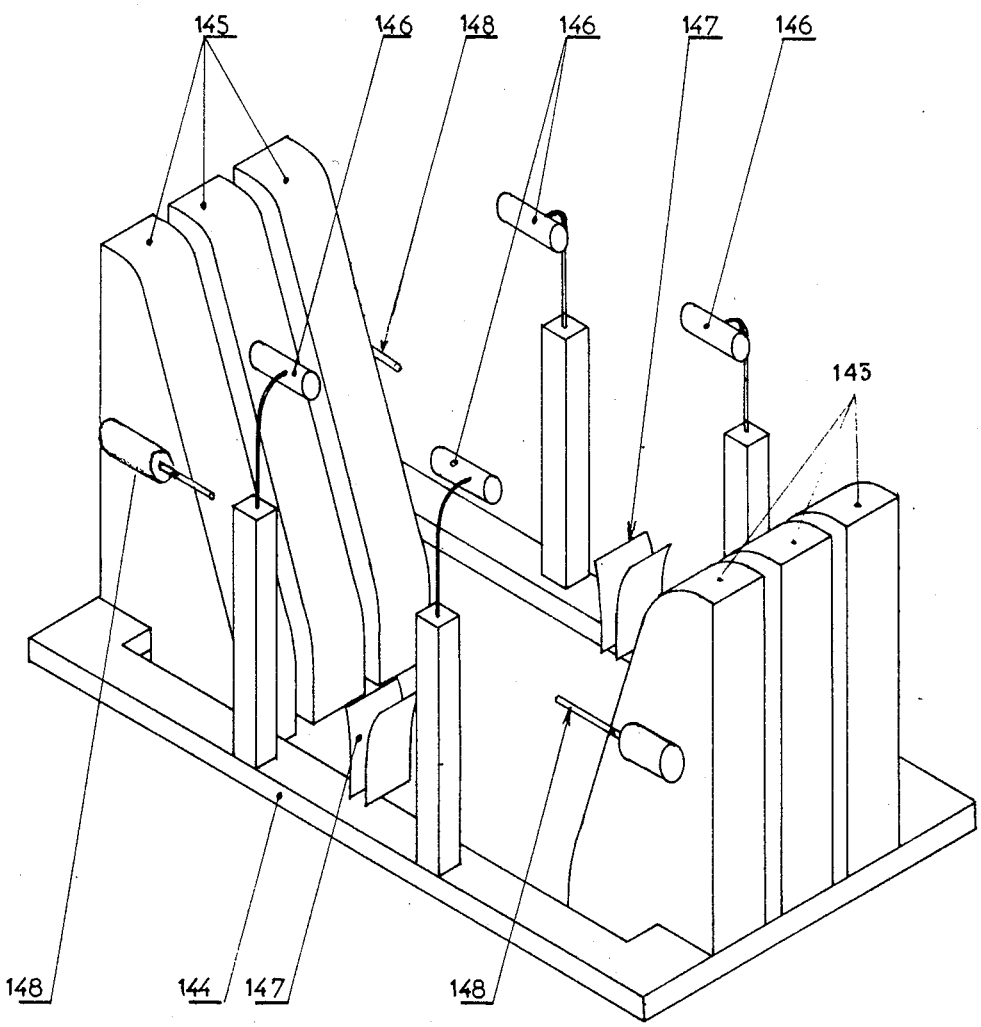
FIG. 9 is a perspective view of the forming unit for the rack.

The forming unit 137 is shown in perspective view and more in detail in FIG. 9.

The forming unit is basically a complex of fixed guides, either cams or deflectors designed to produce the required foldings in the passing of the cut-out through the forming unit 137, according to the procedure shown in the FIGS. 11*a* to 11*j*.

The forming unit 137 consists of a rectangular frame 144 provided with sloped planes 145 intended to raise the portions 19*a*, 19*b*, 19*c* of panels 19 (FIG. 11*e* to 11*h*), with side cams 146 for raising panels 12 to 15 (FIGS. 11*c*, 11*d*), side guides 147 for pressing together the panels 7,8 on the one hand and the panels 9,10 on the other hand (FIG. 11*i*) and with retractable fingers 148 for temporarily holding the cut-out when initially entered into the forming unit at the first stage of the forming (FIG. 11*e*) of the double central partition 1,2.

The first stage of the operating cycle of the machine shown in FIGS. 7 and 8 is the taking of a rack cut-out 149 on the top of the stack 130 by means of the device 131.

Figure 10A:
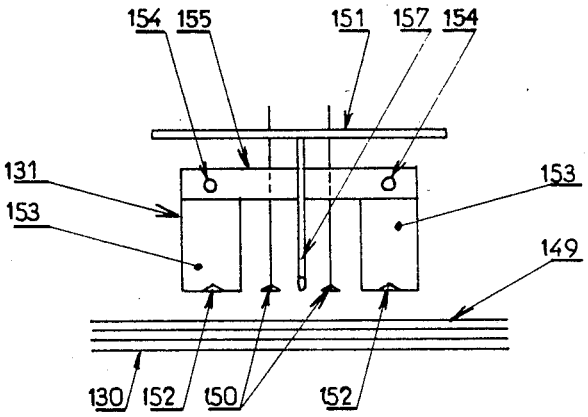
FIG. 10*a* to 10*c* show three stages of the process of gripping the rack cut-outs.
Figure 10B:
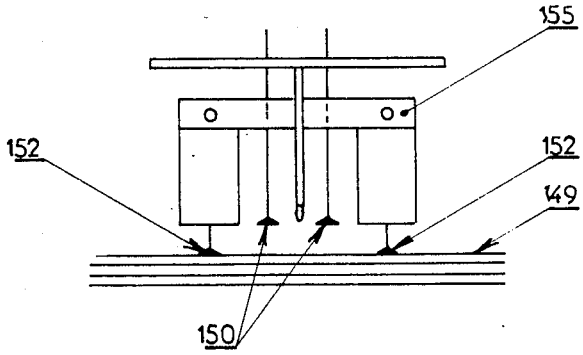
Figure 10C:
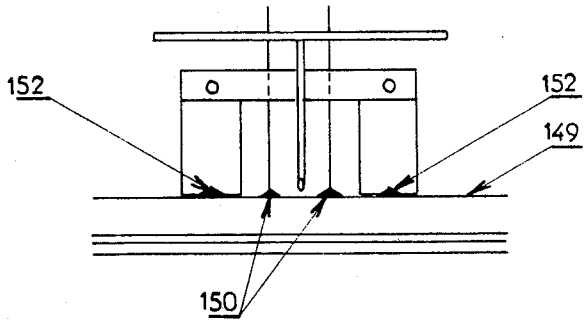

FIGS. 10*a* to 10*c* represent the device 131 of FIG. 7 seen on the left side.

The device comprises a first pair of gripping suckers 150 fixed on a plate 151 that is integral with the carriage 132 and a second pair of gripping suckers 152 capables of vertical motion at the end of arms 153 oscillating on axes 154 on a horizontal crossbar 155; at the gripping stage of a cut-out 149, said crossbar is substantially in a vertical position over the square panels 1 to 4 of the cut-out, each of said four suckers 150, 152 gripping one of said four squares. The width of the arms 153 (FIG. 11*d*) is slightly less than the side of squares 1 to 4.

In addition, the crossbar 155 can be moved vertically by means of a jack 156 (FIG. 7) attached to the carriage 132.

Finally, the row of air suckers 150, 152 is flanked by two vertical fingers 157, that can move vertically with the crossbar 155, said crossbar being carried by the carriage 132, and whose end is bevelled, the purpose of the fingers is to initiate the correct folding of panels 7, 8 and 9, 10 by compelling them to extend towards outside (FIG. 11*b* to 11*e*).

The cut-out 149 on the top of the stack 130 (which is raised gradually at the same rate) is gripped by air-suckers 152, with the crossbar 155 remaining steady (FIG. 10*b*). The cut-out 149 is raised and brought into contact with the air-suckers 150 (FIG. 10*c*).

Figure 11A:
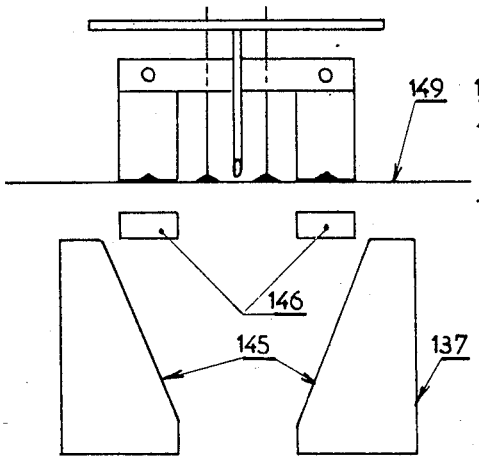
FIG. 11*a* to 11*j* show several stages of the processing of a cut-out through the forming machine until it is inserted in the packing box.
Figure 11B:
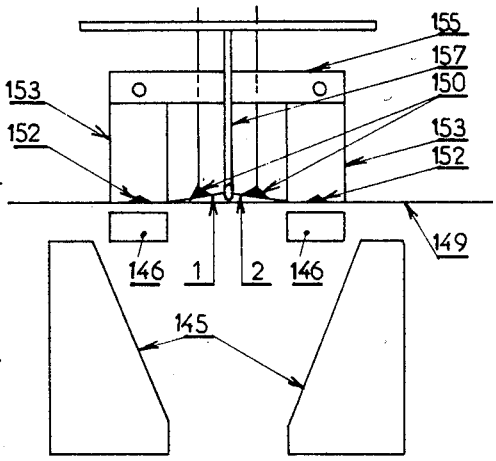
Figure 11C:
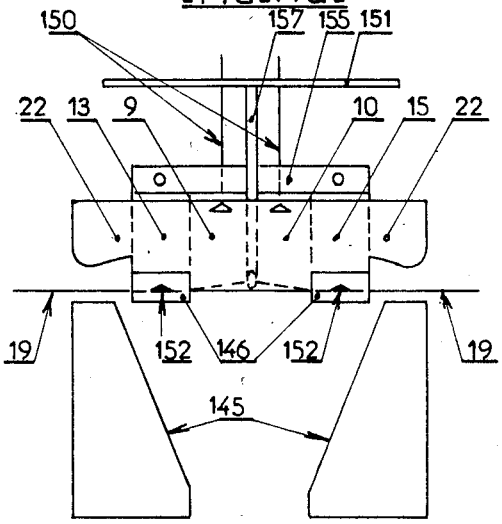
Figure 11D:
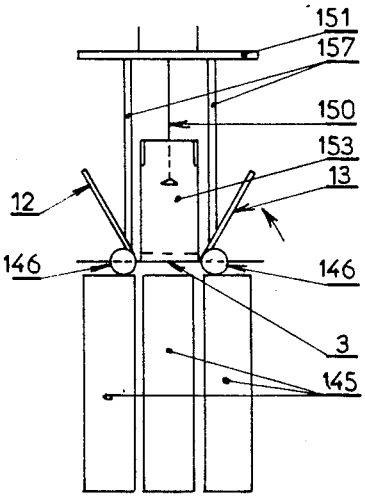

Then the device 131 is brought in a vertical position above the forming unit 137 (FIGS. 11*a*). The initial stage of the forming of the double central wall 1,2 (FIG. 11*b*) is achieved by the gradual lowering of the crossbar 155 and therefore of the arms 153 and the air-suckers 152. The lowering starts the travel process of the cut-out 149 through the forming-unit 137, during which the panels 12 to 15, 19 and 22 are raised and the double walls 1,2; 7,8 and 9,10 are formed by means of cams or guides 145, 146 and 147 as shown in FIGS. 11*c* to 11*i*.

During the travel of the cut-out, the arms 153 are gradually pushed inwards (FIG. 11*e*) by the slide plates 145, so that there is a time when the crossbar 155 stops going down and goes up instead (FIG. 11*f*), leaving room for the pushing plate 136 that completes the formation of the rack (FIG. 11*i*) by pressing the top end of the central portion of the rack, followed by the insertion (FIG. 11*j*) of the fully formed rack into the packing box 138 located vertically under the forming unit 137. As soon as the plate 136 has retracted, the packing box filled with the rack is cleared by the jack 143 (FIG. 8) and removed by the conveyor 139, while a new empty box is fed under the forming unit.

During the operation of the pusher 136, the feeding mechanism 131 grips a new cut-out and the cycle is repeated automatically.

The machine is suitable for handling cut-outs 149 of varying dimensions and configurations, by the proper adjustment of the clamping and guiding systems of the stack 130, of the empty boxes 138, the spacings and dimensions of the operative units 150, 152, 153, 157 of the gripping system 131, and the arrangement of the operative units of the forming unit 137, which can be done very simply by substituting the forming unit by another forming unit suited to the new type of rack to be formed.

The machine permits the formation and the insertion of racks at a speed of, for instance, 750 to 1000 an hour, one shift working, which is beyond comparison with the rates of normal manual processing or the machines now existing.

The above-described machine can process the cut-outs represented in FIGS. 1 and 3 and also the cut-outs of FIG. 5 provided the spacing between the air suckers 150, 152 and between the slide plates in opposite position 145 are adjusted.

Note that the machine can also process cut-outs of the pattern shown in FIGS. 1, 3 and 5 intended for packaging six objects instead of twelve without additional adjustment, such cut-outs lack the panels 19 and 22.

FIGS. 12, 13 and 14a to 14h show an alternative version of the machine in FIGS. 7 and 8.

Figure 12:
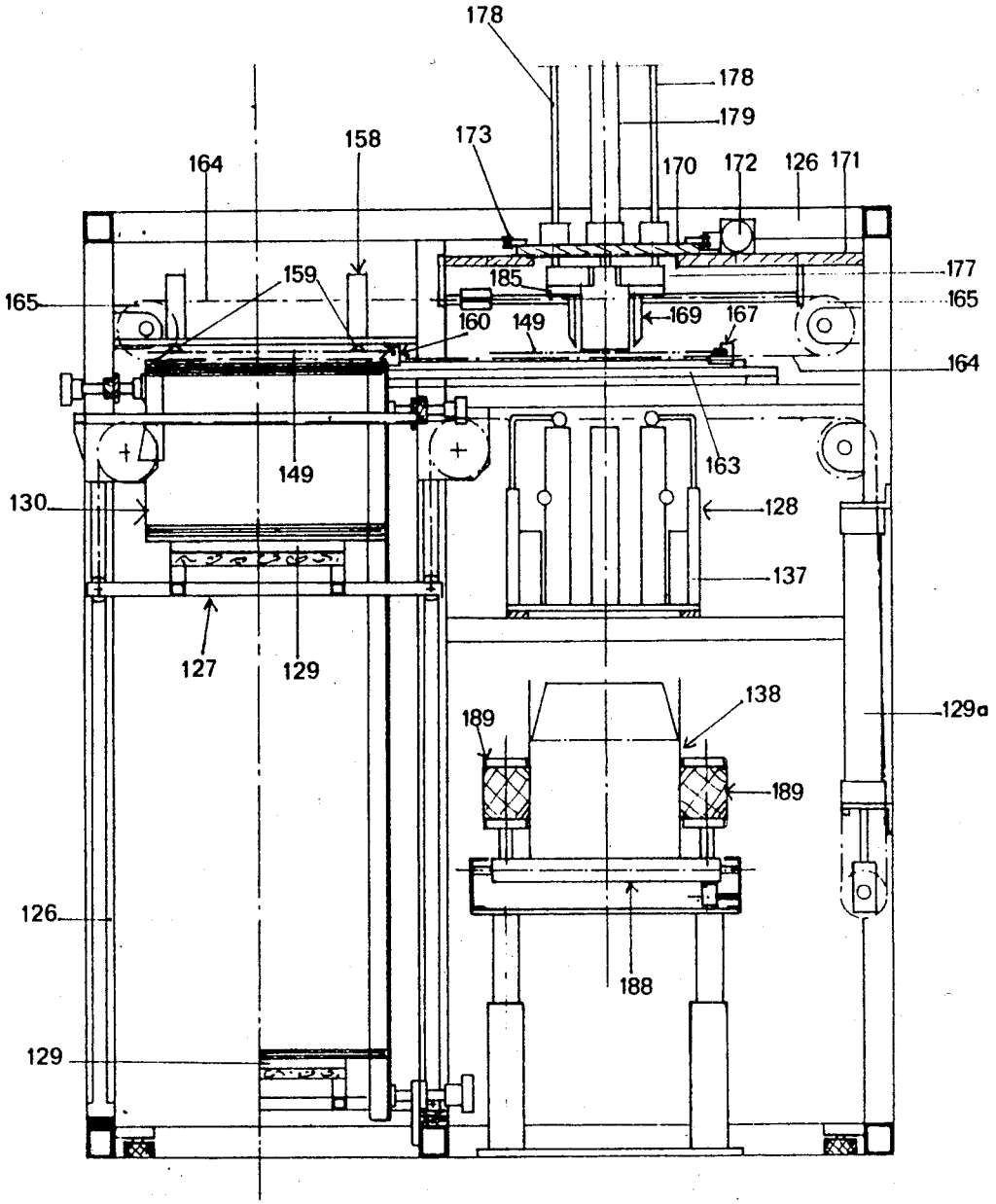
FIG. 12 is a front view of an alternative version of the machine according to the invention.
Figure 13:
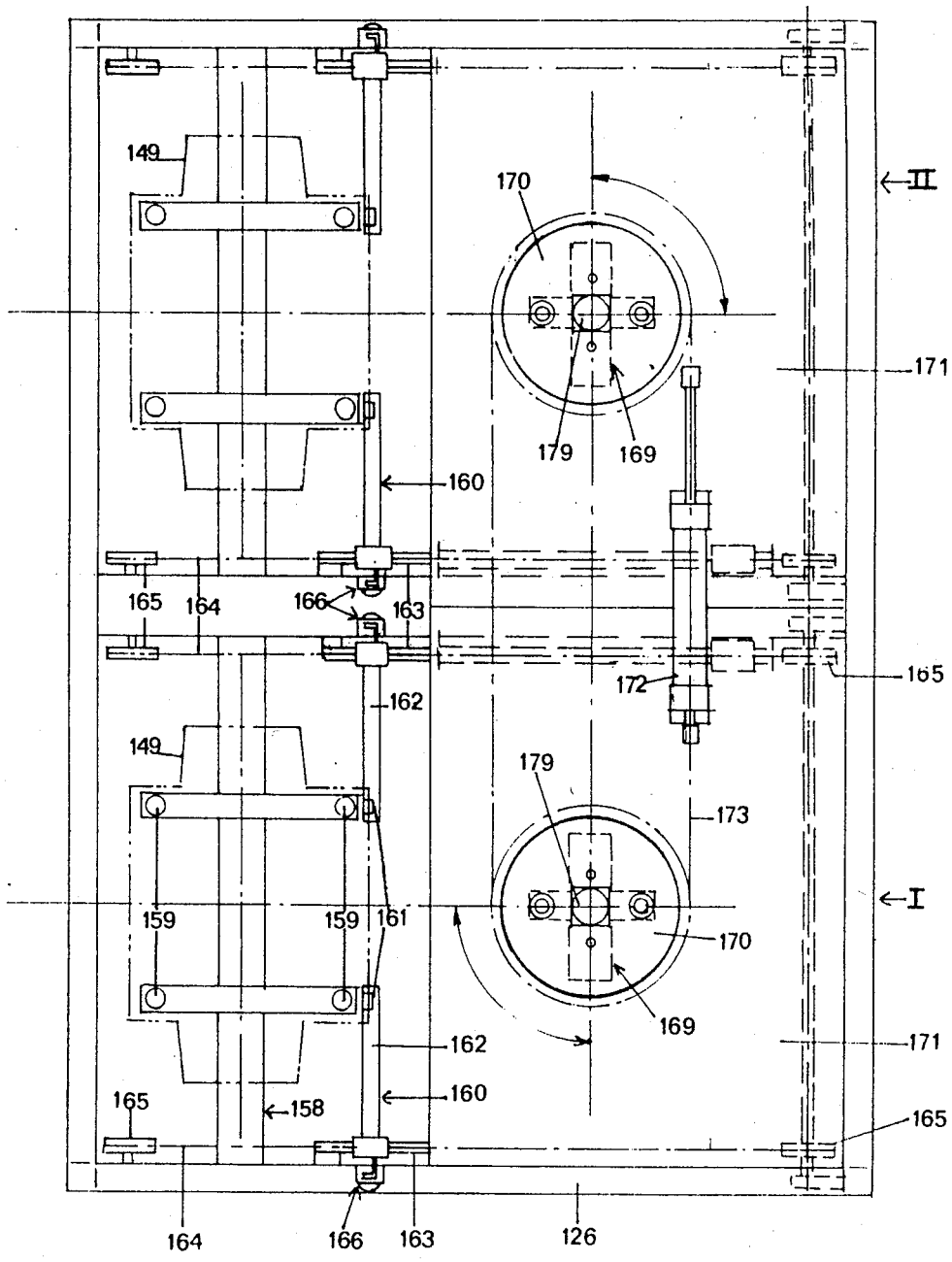
FIG. 13 is a top plan view of the machine in FIG. 12.

The machine shown in FIG. 12 is designed with double working station and comprises, as in FIG. 7, a frame 126, a gripping unit 127 for taking rack cut-outs and a unit 128 for rack forming and insertion into a packing box 138.

A lifting plate 129, complete with actuating jack 129*a* carries a stack 130 of cut-outs as shown for instance in FIG. 3.

The system for gripping and conveying cut-outs individually from the stack 130 to a position above the unit 128 differs from that of the machine shown in FIG. 7.

It comprises a fixed unit 158 provided with suckers 159 for gripping and lifting a cut-out 149 on the one hand, and a conveying device 160 to transfer the cut-out 149 to a position above the forming unit 137 of the unit 128 on the other hand.

The device 160 consists of two clamps 161 fitted at the end of arms 162 sliding along horizontal slides 163 and moving by an arrangement of endless mounted belts 164 and drums 165. The correct positioning of the arms 162 above the stack 130 is ensured by adjustable fixed travel limiters 166, while, above the forming unit 137 it is obtained by adjustable fixed travel limiters 167. The reciprocating motion of systems 164–165 is controlled through a horizontal jack (not shown) whose rod is united to the top end of the belts 164 in adjacent position to the working stations I and II (FIG. 13) of the machine.

The cut-out 149 has been brought above the forming unit 137 and is gripped by the air-suckers 168 (FIG. 14*c* and 14d) of a device 169 to lower the cut-out 149 through the forming unit and into the packing box 138.

The device 169 is carried by an horizontal disc 170 that can rotate in a fixed base 171. The disc 170 can rotate by one quarter revolution when actuated by a fixed jack 172 that drives an endless mounted belt 173 united with the discs 170 of both working stations I and II.

The two suckers 168 are carried by two vertical rods 174 actuated by jacks 175 carried by the disc 170 and controlled by a spring 176. The air suckers 168 are located above the central panels 1 and 2 in cut-out 149.

Moreover the device 169 comprises a cross-shaped horizontal crossbar 177 that moves vertically through vertical rods 178 that go through the disc 170 and are actuated by a vertical jack 179.

The crossbar 177 carries two arms 180 fitted as levers oscillating on axes 181 resting on said crossbar. The crossbar is crossed by two vertical sleeves 182 that maintain the rods 174 of the air suckers 168 and are united with the disc 170. The lower end of the sleeves 182 has a bevel 183 and serves as a control cam for two hooks 184 for locking on the crossbar 177 a pushing plate 185. The plate 185 can move vertically by the action of the rods 178 at whose end it is attached, as the cross-bar 177 can slide on rods 178.

Finally the lower side of the crossbar 177 is provided with two vertical fingers 186 whose end is bevelled.

The operation of the machine is as follows:

The air suckers 159 of the fixed device 158 come down and go up lifting the cut-out 149 from the top of the stack 130. Next, the two clamps 161 seize the cut-out 149 and move it to a position above the forming unit 137 and under the device 169 (FIGS. 14*a*, 14*b*).

Air suckers 168 go down (FIGS. 14*c*, 14*d*) owing to the action of the jacks 175 and grip the cut-out 149 when it is released by the clamps 161.

Figure 11E:
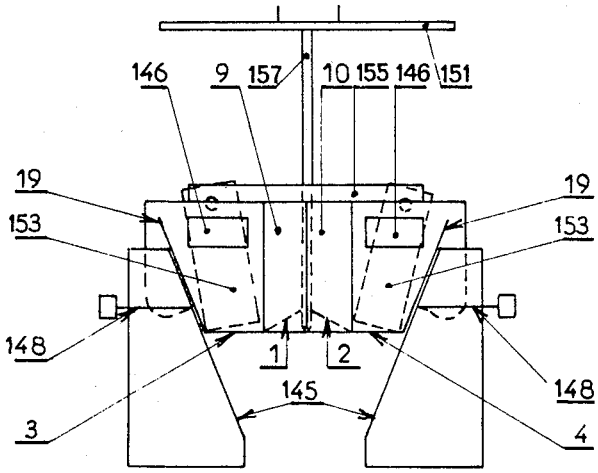
Figure 11F:
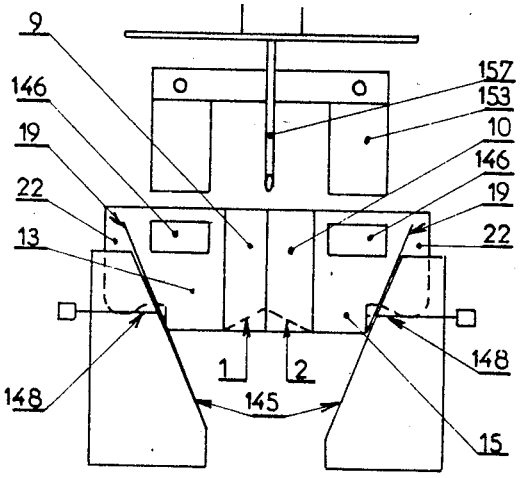
Figure 11I:
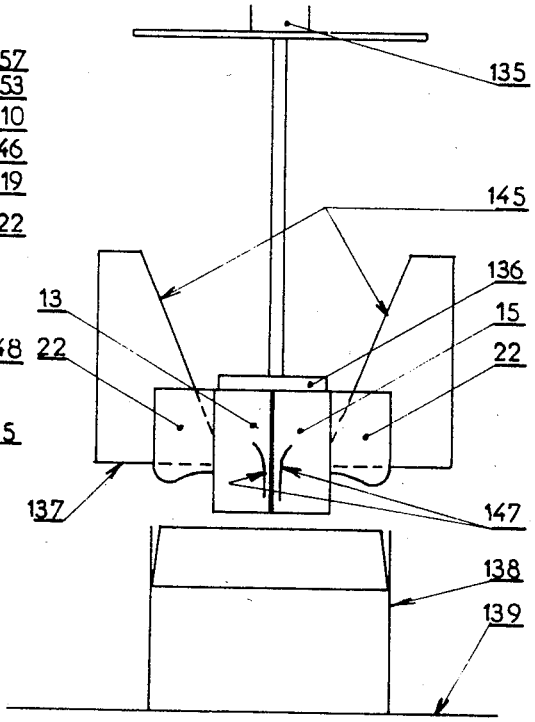
Figure 11G:
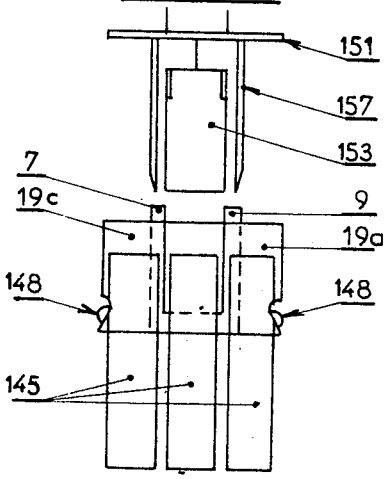
Figure 11H:
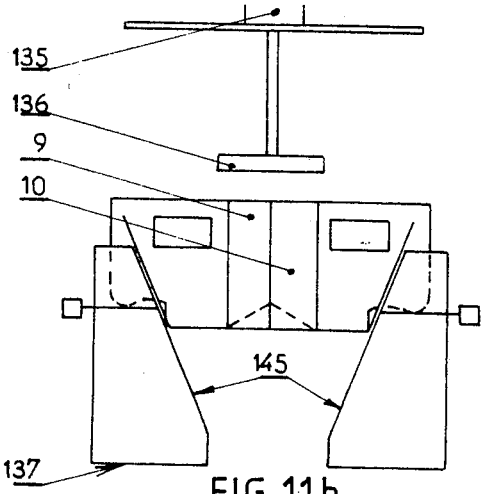
Figure 11J:
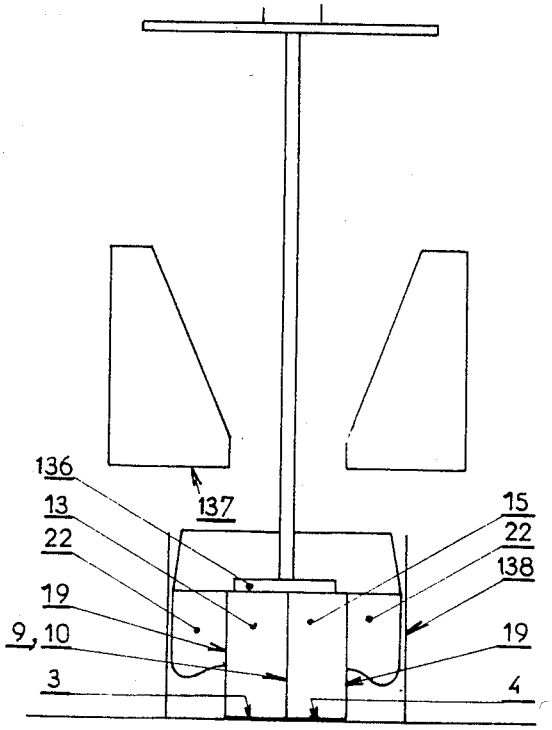

The complex 177–185 is lowered under the control of the jack 179 and of the rods 178 (FIGS. 14*e*, 14*f*), in order to force the forming of the cut-out through the forming unit 137 in the manner described with reference to FIGS. 11*e*, 11*f*. During the process of the insertion of the cut-out 149 into the forming unit 137, the downward progress of the crossbar 177 is stopped (FIG. 14*g*), but the rods 178 continue their travel, so that the plate 185 goes on pushing the cut-out through the forming unit, completes the forming of the rack 187 followed by its insertion in the box 138 (FIGS. 14*g*, 14*h*). The units 180, 186 have an identical purpose to that of the units 153 and 157 in the device of FIGS. 11*d*, 11*e*.

Figure 14A:
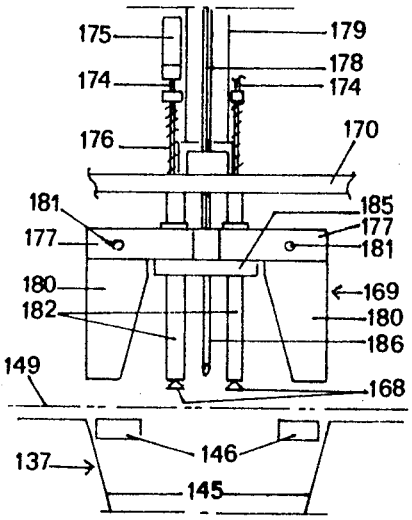
FIG. 14*a* to 14*h* show several stages of the forming process of a cut-out by the machine in FIG. 12.
Figure 14B:
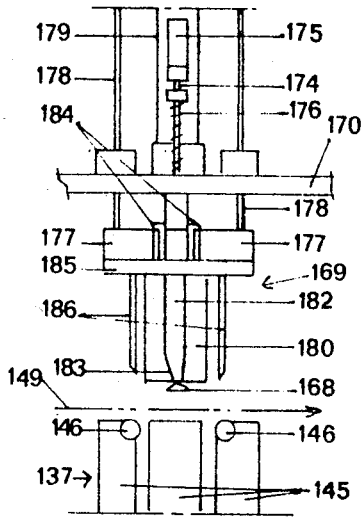
Figure 14C:
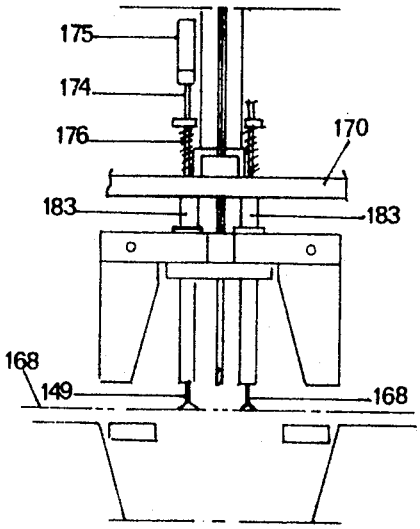
Figure 14D:
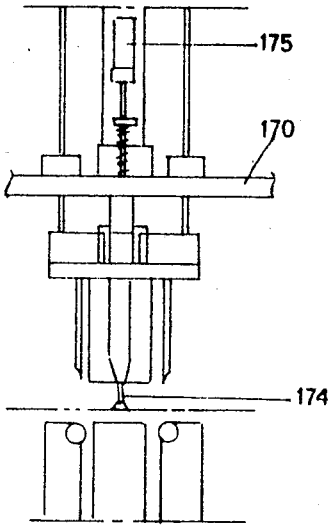
Figure 14E:
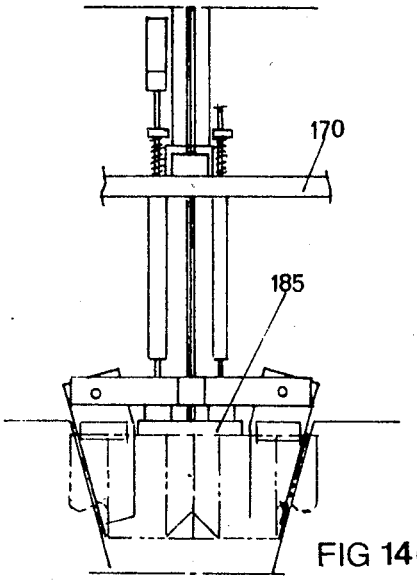
Figure 14F:
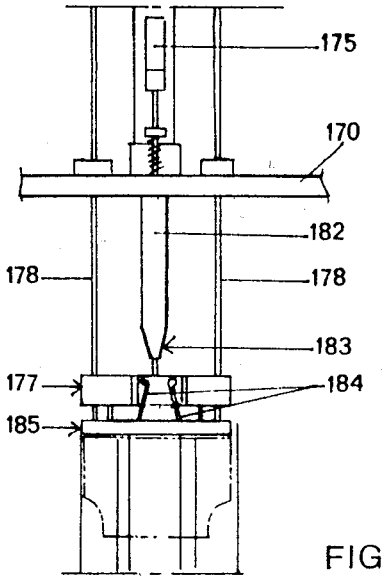
Figure 14G:
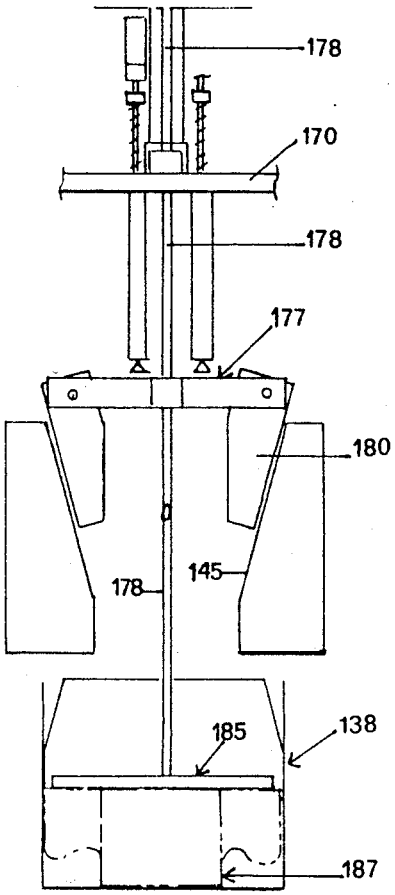
Figure 14H:
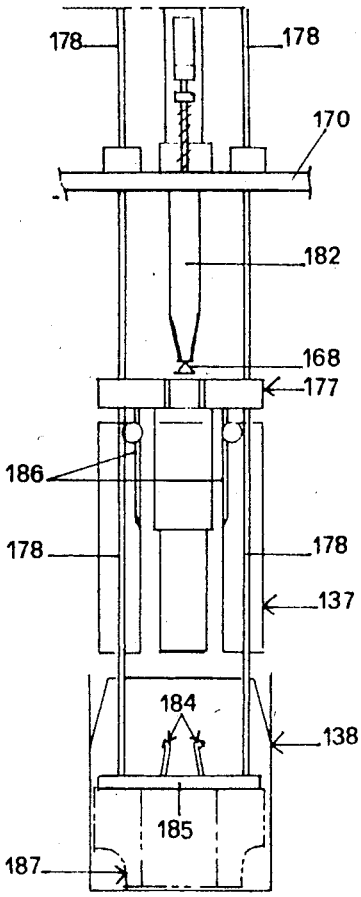

Once the rack is in its position in the box, the rods 178 go up, the plate 185 engages the crossbar 177 and all units are restored to the position shown in FIGS. 14*a*, 14*b* and are ready for processing a new cut-out.

When the plate 185 re-engages the crossbar 177 during its upward motion, hooks 184 are moved upward (FIG. 14*f*) and become locked again against the sides 177*a* of the crossbar, owing to the bevelled portions 183 of fixed sleeves 182 that compel said hooks 184 to come flat against said crossbar.

The packing box 138 is automatically fed and removed owing to the roller conveyor 188 and two side belts 189, provided in order to temporarily hold the box under the forming unit 137 for the time required for the insertion of the rack 187, the belt motion being stopped through a box detection system along the conveyor 188.

The operation of the machine is fully automatic.

The two working positions I and II of the machine are controlled at the same time from one conveyor 188, the necessary means being provided so that both working stations are fed with empty boxes 138 at the same time.

It is obvious that the machine can be equipped with only one working station.

Owing to the rotary method of mounting of discs 170 and of forming heads 169, it is possible to process packing boxes 138 suitable for 6 or 12 bottles on the same processing line in the same alignment without rotating the boxes suitable for six bottles, said feature being achieved by a 90° rotation controlled by the jack 172.

In this case the forming unit 137 that is designed to process racks with twelve positions as well as racks with six positions is rotated by 90° too, this operation is done manually as the forming unit is easily removable.

Finally the invention is obviously not restricted to the methods of embodiment shown and described in the above but on the contrary it relates to all alternative versions, and more particularly regarding the technology of obtaining the means that ensures the transfer of the cut-out and their forming into a rack, specially the forming unit.

What is claimed is:

1. A dividing rack for parallelepipedal packing box, made from on cardboard flank that is cut out, grooved and formed in order to build a plurality of adjacent individual divisions which comprise rectangular panels, solid with each other, and divided by orthogonal and parallel cutting and grooving lines, which, when the rack is formed comprises:

a double vertical central partition aligned in a first plane, two double lateral partitions aligned in said first plane on opposing sides of said double vertical central partition, first single-panel partitions aligned in second planes orthogonal to said first plane between said double lateral partitions and said double vertical central partition, second single panels extending in continuation of said first single panels, third single panels aligned in a third plane parallel to said first plane and running between said first single panel partitions and said second single panels, wherein said double vertical central partition includes outwardly protruding portions defined by cutups which divide panels of the double vertical central partition and the double lateral partitions, and wherein said third single panels and said second single panels include slot means for locking said third single panels at right angles to said second single panels;

wherein each protruding portion is defined by a flap made in one panel of the double vertical central portion which encroaches on the other panel; and wherein said cut-ups define an inwardly projecting portion in the vicinity of joints between panels of the double lateral partitions which is a transversal wedge for the rack at the base of the packing box.

2. A rack according to claim 1, wherein said slot means comprises slots between said third single panels with inner ends cooperating with locking projections provided at joints between said first single panel partitions and said second single panels.

3. A rack according to claim 2, wherein an outer end of said slots exhibits a notch which cooperates with a locking slot located at said joints between said first single panel partitions and said second single panels.

4. A rack according to claim 3, wherein said notch is S-shaped.

5. A rack according to claim 1, wherein joints between said double lateral partitions and adjacent first single panel partitions feature incisions which define folding lines of substantially equal length.

6. A rack according to claim 1, wherein folding lines of the double vertical central partitions and the double lateral partitions are provided with incisions.

7. A rack according to claim 1, wherein said double lateral partition comprises a first and a second panel wherein said first panel exhibits an outwardly projecting portion which corresponds to an inwardly projecting area of said second panel thereby reducing the amount of cardboard required for said double lateral partition.

8. A rack according to claim 7, wherein said double vertical central partition comprises a first and a second panel, wherein said first panel exhibits an outwardly projecting portion which corresponds to an inwardly projecting area of said second panel and said second panel exhibits an outwardly projecting portion which corresponds to an inwardly projecting area of said first panel; and wherein said first panel of said double lateral partition comprises a second outwardly projecting portion corresponding to an inwardly projecting area of a panel of said first single-panel partitions.

* * * * *